United States Patent [19]

Washer

[11] Patent Number: 4,623,443

[45] Date of Patent: Nov. 18, 1986

[54] HYDROCARBON CONVERSION

[75] Inventor: Stone P. Washer, Bartlesville, Okla.

[73] Assignee: Phillips Petroleum Company, Bartlesville, Okla.

[21] Appl. No.: 577,935

[22] Filed: Feb. 7, 1984

[51] Int. Cl.[4] ..... C10G 65/12

[52] U.S. Cl. ..... 208/67; 208/143; 208/95; 585/254; 585/250

[58] Field of Search ..... 208/143, 67; 585/254, 585/250

[56] References Cited

U.S. PATENT DOCUMENTS

| | | | |
|---|---|---|---|
| 2,053,753 | 9/1936 | Slyngstad et al. | 208/78 |
| 2,575,258 | 11/1951 | Corneil et al. | 252/417 |
| 3,050,457 | 8/1962 | Wilson | 208/67 |
| 3,205,275 | 9/1965 | Johnson | 260/667 |
| 3,424,672 | 1/1969 | Mitchell | 208/164 |
| 3,542,668 | 11/1970 | Pool | 208/67 |
| 3,894,931 | 7/1975 | Nace et al. | 208/73 |
| 3,894,934 | 7/1975 | Owen et al. | 208/78 |
| 3,894,935 | 7/1975 | Owen | 208/164 |
| 3,894,936 | 7/1975 | Owen | 208/164 |
| 3,974,062 | 8/1976 | Owen et al. | 208/74 |
| 4,090,949 | 5/1978 | Owen et al. | 208/78 |
| 4,104,152 | 8/1978 | Hilfman | 208/143 |
| 4,146,465 | 3/1979 | Blazek Sr. et al. | 208/120 |
| 4,268,416 | 5/1981 | Stine et al. | 252/416 |
| 4,280,895 | 7/1981 | Stuntz et al. | 208/113 |
| 4,280,896 | 7/1981 | Bearden et al. | 208/113 |
| 4,382,015 | 5/1983 | Castillo et al. | 252/417 |
| 4,404,090 | 9/1983 | Castillo et al. | 208/120 |

*Primary Examiner*—William R. Dixon, Jr.
*Assistant Examiner*—Cynthia A. Prezluck
*Attorney, Agent, or Firm*—Mark A. Montgomery

[57] ABSTRACT

A hydrocarbon conversion process wherein metal-coated or metal-contaminated cracking catalyst is regenerated, reduced and then used to hydrogenate an olefin.

18 Claims, 1 Drawing Figure

HYDROCARBON CONVERSION

Figure 1:
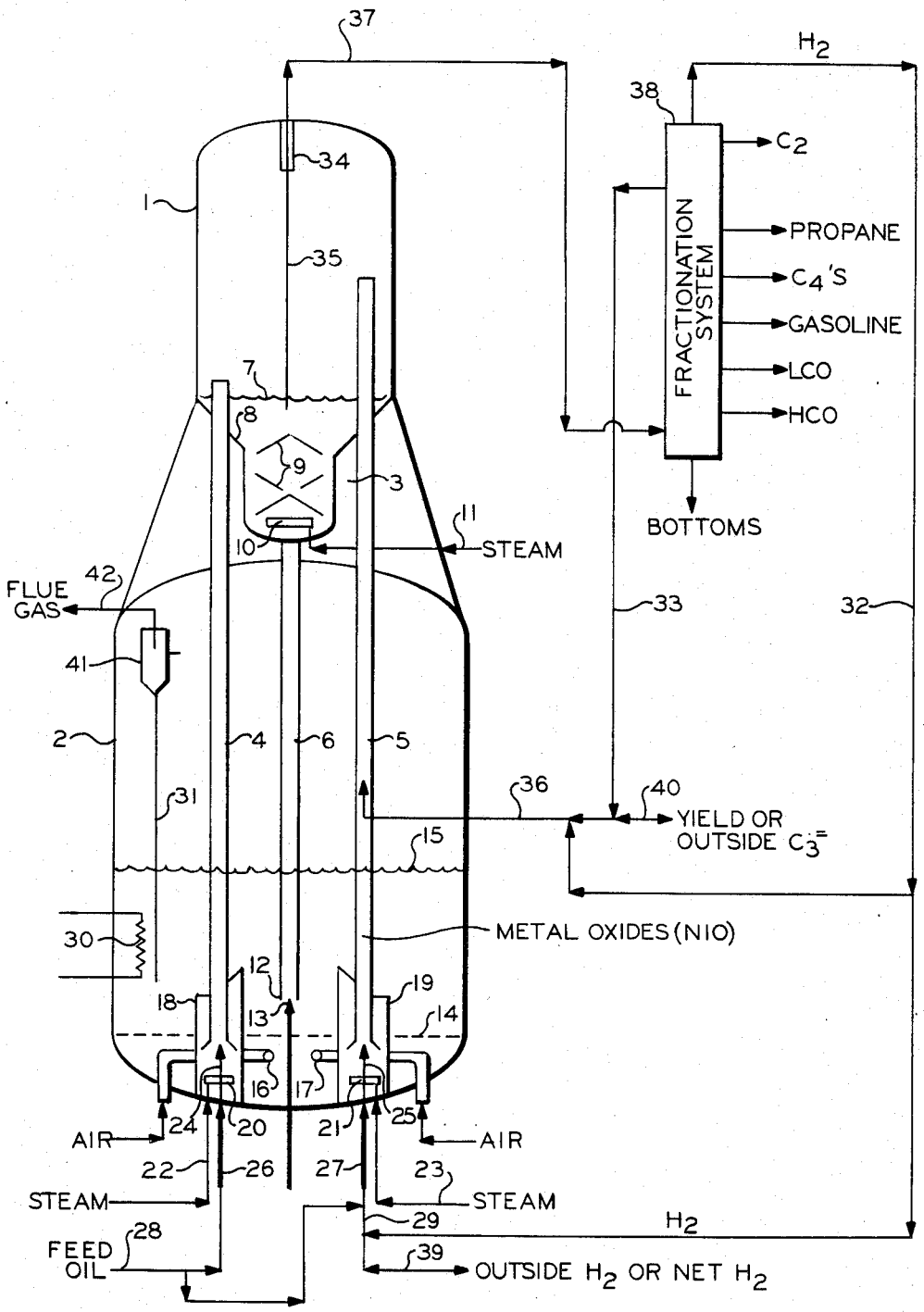

The present invention relates to the process for the hydrogenation of unsaturated hydrocarbons with a reduced regenerated catalyst. In another aspect, this invention relates to the conversion of olefins produced from a catalytic cracking process to more useful hydrocarbons. This invention also relates to the use of a reduced, regenerated, used, metal-coated cracking catalyst as a catalyst in a hydrogenation process.

It is known to catalytically hydrogenate an unsaturated hydrocarbon to a saturated hydrocarbon, such as propylene to propane. It is also known to reduce regenerated metal-contaminated cracking catalyst. U.S. Pat. No. 2,575,258 discloses one such process in which equilibrium silica-alumina catalyst is first regenerated by air for combustion of coke which was deposited on the catalyst during the cracking, and the regenerated catalyst is subjected to reduction with a reducing gas to counter the effects of contaminating metals.

In the catalytic cracking process an excess of olefins is usually produced, such as propylene. Olefins are less useful for some purposes than the corresponding saturated hydrocarbons. It could, therefore, be advantageous to convert the unsaturated hydrocarbons to the saturated hydrocarbons (such as propylene to propane) making the products of a catalytic cracking process more usable or salable. It is an object of the present invention to provide a process for the conversion of olefins to saturated hydrocarbons.

It is also an object of the present invention to provide a process for the production of useful products from the excess olefin produced in a catalytic cracking process.

It is another object of this invention to produce a used, metal-coated equilibrium cracking catalyst that is useful in the hydrogenation process to hydrogenate olefins.

Other aspects, objects, and advantages of the present invention will be apparent from the following description.

In accordance with the invention, a process for the hydrogenation of olefins is provided comprising contacting a used regenerated metal-coated or metal-contaminated cracking catalyst with a reducing gas under reducing conditions to reduce at least a portion of said metals and contacting the now reduced, regenerated metal-coated cracking catalyst with a mixture of hydrogen and at least one olefin under hydrogenation conditions to produce hydrogenated olefins.

In accordance with another embodiment of the present invention, there is provided a process for the saturation of an olefin, said process comprising contacting a used, metal-coated or metal-contaminated equilibrium cracking catalyst with an oxygen-containing gas under regeneration conditions, contacting said catalyst with a reducing gas under suitable conditions to convert at least a portion of said metals present as the oxide to the metal, then contacting the now reduced, regenerated metal-coated or metal-contaminated catalyst with a mixture of hydrogen and olefin under hydrogenation conditions, thereby hydrogenating the olefin.

In accordance with one specific embodiment, in multi-riser type catalytic cracking wherein metal (e.g., nickel)-contaminated catalyst is present, gas oil and/or topped crude is cracked in one riser to produce cracked products which are fractioned to yield hydrogen and propylene streams, the produced propylene, along with added hydrogen, is charged to a second riser to which hydrogen-treated regenerated catalyst (the nickel oxide having been reduced to nickel) is charged, and wherein propylene is hydrogenated to propane which is recovered from the fractionation.

The present invention is beneficial for use with catalysts of alumina, silica, silica-alumina, etc., containing nickel and/or vanadium contaminants. The present invention is also suitable for hydrogenating olefins, diolefins and also aromatics having 2 to about 12 carbon atoms per molecule, for example ethylene, propylene, butylene, butadiene, benzene, toluene etc., the preferred olefin being propylene.

The hydrogenation of the present invention can be carried out in the same reactor where the oil feed is cracked, or in a separate hydrogenation unit. The present invention is particularly beneficial for use in a single multi-riser catalytic cracking reactor. If carried out in the same multi-riser reactor, propylene and hydrogen can be contacted with the catalyst in one of the risers, either with or without the simultaneous presence of oil feed.

In a catalytic cracking reactor, the cracking catalyst usually becomes contaminated with metals and coke and after a time the catalyst is rendered substantially inactive. The catalyst is usually regenerated by combustion to remove the coke from the catalyst. This oxidizes the metals contaminated thereon. The catalyst is then subjected to a reducing gas to reduce the oxides of the contaminated metals (e.g., NiO→Ni). The reduced catalyst is then recycled back to the catalytic cracking reactor to crack the hydrocarbon feed.

During the catalytic cracking process a fairly large amount of olefin is produced. This is not always a desirable product.

According to the present invention the hydrogen and olefin can come from the separation of the products from the catalytic cracking process or from an outside source and are contacted either in the same multi-riser catalytic cracking reactor or in a different hydrogenation reactor with the reduced regenerated metal-contaminated catalyst thus hydrogenating said olefin to a more useful saturated hydrocarbon (for example, propylene is hydrogenated to propane).

The hydrocarbon feed to the catalytic cracking unit can include any hydrocarbon that can be cracked to lighter products. Typical feeds include gas oils, fuel oils, cycle oils, slurry oils, top crudes, oil from tar sands, heavy residual and the like. Many of the heavy oil feeds currently employed contain at least one of the metals, nickel, vanadium, and iron, generally in amounts within the ranges set forth in the following table:

TABLE I

| Metal | Content, ppm* |
|---|---|
| Nickel | .02 to 100 |
| Vanadium | .02 to 500 |
| Iron | .02 to 500 |

*The term "ppm" refers to parts per million of metal as the element by weight.

The catalytic cracking can be carried out under any condition suitable for cracking the hydrocarbon feed. Typically that involves contacting the catalyst with the feed at temperatures in the range of about 800° F. to about 1500° F. Pressures can generally range from subatmospheric to about 3,000 psig. Typically the weight ratio of catalyst to hydrocarbon feed is in the range of about 3:1 to 30:1.

The hydrogenation can be carried out under any conditions suitable for hydrogenating olefins. Typically, that involves contacting the reduced regenerated metal-coated catalyst with the olefin and hydrogen feed at about the same conditions as the oil cracking process, since both reactions can be carried out in the same multi-riser reactor, either in the same riser(s) or in different risers. Thus the hydrogenation of olefins and the cracking of oil can be carried out concurrently in the same riser(s) or in different risers of the same reactor.

The olefin and hydrogen feed for the hydrogenation process usually come from the cracking process and are separated from the rest of the products of the cracking process. However, external sources could supply all or part of the olefin and/or hydrogen used in the hydrogenation process.

The separation of the products from the cracking and hydrogenation processes can be done in any conventional separation process; however a fractionation system is preferred.

In the reducing step the regenerated catalyst is contacted with the reducing gas. Generally any suitable reducing gas can be employed, hydrogen being the most preferred. Accordingly, sources of the reducing gas can include regenerator off gases or light gaseous streams from the cracker.

The volume of reducing gas employed in contacting the catalyst and the temperatures and pressures maintained should be adjusted so as to convert substantially the contaminating metal oxides present in the equilibrium catalyst to compounds having substantially less or no detrimental effect on the activity of the catalyst. Depending upon the nature of the contaminating materials and upon the amount and kind of reducing gas employed, the temperature at which the contaminated catalyst is contacted with the reducing atmosphere can vary, but generally will be within the range of about 850° F. to about 1300° F. Inasmuch as the pressure maintained in the several known catalytic cracking processes may differ and since the pressure maintained will have an influence on the reactions which take place in the reducing atmosphere, the temperature and throughput must be correlated in each instance with the pressure maintained at the particular unit.

It should be remembered that the volume of reducing gas required will also depend upon the nature and amount of contaminating oxides. When relatively small quantities of contaminating oxides are present in the catalyst, very small volumes of reducing gas and/or short contact times may be employed with satisfactory results, while when relatively large quantities of contaminating oxides are present in the catalyst, larger volumes of reducing gas and/or long contact times will be required.

Typically the amount of hydrogen injected will be in the range of about 0.1 to about 20 standard cubic feet per pound of contaminating metals on the catalyst. Contact times will generally be in the range of about 0.01 minutes to about 60 minutes, preferably about 0.01 to about 30 minutes.

U.S. Pat. No. 3,053,753 discloses an apparatus that with modifications could be useful for the process of the present invention and is incorporated herein by reference.

The invention will now be described in regard to a specific application in a multi-riser catalytic cracking reactor as illustrated in FIG. 1. In this description propylene is used, but the use of other olefins is within the scope of this invention.

A substantially vertical and unitary vessel is shown having an upper chamber 1, an intermediate stripping chamber 3, and a lower regeneration chamber 2.

Riser reactor conduits 4 and 5 are provided for conveying regenerated finely divided catalytic material from the lower portion of the regeneration chamber upward therethrough and into the upper chamber 1. A standpipe 6 is provided for conveying stripped catalyst from the bottom of the stripping chamber 3 to the lower portion of the regeneration chamber 2. While only two riser reactor conduits 4 and 5 are shown, it is to be understood that a plurality of reactor conduits may be employed.

The upper chamber is an enlarged cylindrical chamber which may contain a relatively dense fluid bed of finely divided catalytic material 7.

The stripping chamber 3 is a cylindrical chamber contiguous with and positioned below the enlarged cylindrical upper chamber. The cylindrical stripping chamber is connected to the upper chamber by a baffle member 8 in the form of an inverted conical frustrum through which the plurality of riser conduits extend into the enlarged cylindrical reactor chamber. The stripping chamber 3 is provided with a plurality of downwardly sloping and alternately staggered baffle members 9, the slope of which is at least 45° from the horizontal.

A distributor ring 10 or other suitable distributing means connected to conduit 11 is positioned in the lower portion of the stripping chamber for the introduction of steam which passes upwardly through the stripping chamber, countercurrent to downwardly moving, finely divided catalytic material.

The finely divided catalytic material separated from the reaction product in the upper chamber and the stripping chamber is withdrawn from the lower portion of the stripping chamber and passed downwardly through standpipe 6 to a standpipe discharge outlet 12, having a vertically movable plug valve 13 aligned therewith for controlling the rate of catalyst discharged from the standpipe.

Positioned substantially horizontally across the lower cross section of the enlarged cylindrical regeneration chamber 2 and beneath the standpipe discharge outlet 12 is positioned a perforated grid member 14 to provide for more uniform distribution of the regeneration gas introduced beneath the grid to the bottom cross sectional area of catalyst bed 15 maintained above the grid under regeneration conditions. Regeneration gas is introduced beneath the grid 14 for passage upwardly therethrough by suitable distributor means shown as rings 16 and 17.

Positioned in the lower portion of the regeneration chamber and extending upwardly from the dish-shaped bottom thereof and through the grid means are at least two substantially vertical and cylindrical baffle members 18 and 19 which form wells surrounding the inlets to the risers 4 and 5, thereby forming an annular space therebetween.

The well wall adjacent to the standpipe is increased in height to substantially reduce the tendency of contaminated catalyst discharged from the standpipe from passing directly into the well before it has been subjected to regeneration treatment. Positioned in the lower portion of each well is provided a suitable distributor means such as distributor rings, 20 and 21 connected to conduits 22 and 23, respectively, for introducing steam thereto. Positioned within each well and aligned with the riser inlet is provided suitable vertically movable hollow stem plug valves 24 and 25 connected to conduits 26 and 27, respectively, through which liquid and/or gasiform material may be introduced for mixing with regenerated catalyst, and thereafter passing the mixture upwardly through the riser conduits 4 and 5 under desired conversion conditions.

Conduits 28 and 29 connected to conduits 26 and 27, respectively, are provided for the purpose of introducing hydrocarbon feed, reducing gas or dispersion gasiform material such as steam or a suitable lift gas as the situation demands. When reduction and hydrogenation is carried out in a riser as is shown in riser reactor conduit 5 then a reducing gas is introduced through line 29 instead of or in combination with a hydrocarbon feed.

The regenerator is provided with suitable heat exchange coils 30 for controlling regeneration temperatures, as herein discussed, which may be independently controlled for circulating cooling fluid therethrough.

Regenerated catalyst is withdrawn from the relatively dense fluid bed of catalyst in the regeneration chamber 2 and is passed downwardly inside the baffle members 18 and 19. An annular stream of fluffing or stripping gas rises countercurrent to the catalyst at the inlet of the riser conduits. The regenerated catalyst is then mixed with gasiform and/or liquid material and passed upwardly through the riser reactor conduits 4 and 5 under desired conditions as herein discussed.

Products of combustion resulting from regeneration of the catalyst by burning of carbonaceous deposits on the catalyst with air and containing entrained catalyst fines are removed from the upper portion of the regeneration chamber 2 by cyclone separator equipment means 41 having dipleg 31 and flue gas outlet conduit 42.

Gasiform material separated from finely divided catalytic material in the upper chamber 1 and in the stripping chamber 3 is passed through suitable cyclone separator equipment means designated 34 having dipleg 35 and thereafter the gasiform material is withdrawn from the upper portion of the chamber by conduit 37 for passage to suitable separation and recovery equipment 38 where the products are separated into their different fractions. Hydrogen exits via line 32, propylene via line 33.

At least one of the riser reactor conduits is used to reduce the contaminated metal oxides on the catalyst and to hydrogenate the olefin as in riser reactor conduit 5. Conduit 29 delivers hydrogen and/or oil, preferably only hydrogen, to the bottom of the riser reactor conduit 5 and rises with the catalyst through the conduit, thereby reducing the metal oxides contained thereon. Part way up after the metal oxides have been reduced, propylene or a mixture stream of hydrogen and propylene are charged to the riser reactor conduit 5 via line 36. In rising through the remainder of the riser reactor conduit, the olefin is hydrogenated and exits the top of the conduit.

The length of the conduits in the upper chamber 1 can vary depending upon conditions.

Products from the hydrogenation mix with the cracking products exit together through the top of the reactor via line 37 and enter a fractionation system 38 where they are fractionated into their different components as described in the cracking process. At least part of the hydrogen and olefin exiting the fractionation system are recycled to the hydrogenation zone of the riser reactor. Line 39 can carry net hydrogen away from the system or outside hydrogen into the system and line 40 can carry net propylene away from the system or outside propylene into the system. Propylene could also be added with the hydrocarbon feed via line 28.

EXAMPLE

This example illustrates the use of a commercial equilibrium (i.e., used) aluminosilicate zeolite cracking catalyst for the hydrogenation of propylene. The cracking catalyst, identified as J 3259 (generally employed in one of the cracking units at the refinery of Phillips Petroleum Company in Borger, Tex.) had a pore volume of 0.34 $cm^3/g$, a surface area of 84.6 $m^2/g$, and contained 0.13 weight-% C, 0.28 weight-% Ni, 0.50 weight-% V, 0.70 weight-% Fe, 0.68 weight-% Na, 0.21 weight-% Ce and less than 0.01 weight-% Sb.

35 grams of this catalyst were charged to a quartz reactor and then fluidized in a stream of nitrogen introduced through an inlet at the bottom of the reactor, which was then heated to about 350° C. When this temperature was attained, the nitrogen stream was discontinued and hydrogen was passed through the unit at a flow rate of about 50 $cm^3$/minute, at 950° F. in order to reduce metal oxides in the catalyst. After purging the reactor with hydrogen for 10 minutes the catalyst had turned black. Propylene gas was then added at a flow rate of 30 $cm^3$/minute to the hydrogen feed stream.

The exiting gas was passed through an ice-cooled condenser/receiver, where less volatile components condensed, and was then collected in a collection sphere submerged in an ice bath for 15 minutes. $N_2$ was added to the partially filled sphere so as to attain atmospheric pressure in the sphere. The collected gas mixture was finally analyzed by means of a gas chromatograph. Analytical results are summarized in Table II.

TABLE II

| Component | Mole % in Product |
|---|---|
| Hydrogen | 26.67 |
| Nitrogen[1] | 64.12 |
| Oxygen | 0.31 |
| Carbon Monoxide | 0.04 |
| Methane | 1.15 |
| Ethane | 0.37 |
| Ethylene | 0.25 |
| Propane | 4.26 |
| Propylene | 2.36 |
| n-Butane | 0.12 |
| Isobutane | 0.44 |
| Butenes | 0.16 |
| n-Pentane | 0.01 |
| Isopentane | 0.11 |
| $C_6^+$ Hydrocarbons[2] | 0.15 |

[1]introduced after reaction to the collection sphere;
[2]hexanes, hexenes and higher alkanes and alkenes;

Data in Table II clearly shows that a major portion of the propylene feed was indeed converted to propane. The formation of coke on the catalyst was negligible: Approximately 0.16 weight percent as determined from gain in weight of catalyst.

I claim:

1. A process for hydrogenating an olefin comprising cracking a hydrocarbon with a regenerated metal-coated catalyst under cracking conditions in a cracking zone, transferring said catalyst to a regeneration zone where it is contacted with an oxygen-containing gas and regenerated, continually transferring portions of said regenerated catalyst to said cracking zone while continually transferring other portions to a reduction zone wherein said catalyst is exposed to a reducing gas under conditions to reduce the metals thereon, transferring said cracking hydrocarbons to a separating zone where $H_2$ and olefins are separated from the rest of the products, contacting at least a portion of said hydrogen and olefins with said thus reduced catalyst in a hydrogenation zone hydrogenating said olefins, transferring the products to said separation zone, and transferring said catalyst to said regeneration zone.

2. A process according to claim 1 wherein said reducing gas is hydrogen.

3. A process according to claim 2 wherein the catalyst is coated with at least one metal selected from the group consisting of nickel vanadium and iron.

4. A process according to claim 1 wherein the $O_2$ containing gas is air.

5. A process according to claim 1 wherein the catalyst is reduced at a temperature of about 850°-1300° F.

6. A process according to claim 2 wherein said catalyst is on aluminosilicate zeolite cracking catalyst.

7. A process according to claim 1 wherein said olefin is propylene.

8. A process according to claim 1 wherein said hydrocarbon is gas oil.

9. A process according to claim 1 wherein said hydrocarbon is topped crude.

10. A process according to claim 1 wherein the hydrogenation of olefins and cracking of oil is carried out in the same reactor.

11. A process according to claim 10 wherein said process is carried out in a riser reactor.

12. A process according to claim 10 wherein said process is carried out in a multi-riser reactor.

13. A process according to claim 12 wherein hydrogenation of olefins and cracking oil is carried out in the same riser(s).

14. A process according to claim 12 wherein hydrogenation of olefins and cracking of oil is carried out in different risers of the same reactor.

15. A continuous process for the hydrogenation of olefins comprising contacting a used, metal-contaminated cracking catalyst with an oxygen containing gas under regeneration conditions thereby producing a regenerated, metal-contaminated catalyst, contacting said regenerated metal-contaminated catalyst with a reducing gas under reducing conditions thereby producing a reduced regenerated, metal-contaminated catalyst, then immediately thereafter contacting the reduced, regenerated metal-contaminated cracking catalyst with a mixture of hydrogen and olefin under hydrogenation conditions, thereby hydrogenating the olefin.

16. A process according to claim 15 wherein said reducing gas is hydrogen, said oxygen containing gas is air, said catalyst is a nickel-contaminated aluminosilicate zeolite cracking catalyst, and said olefin is propylene.

17. A process for the conversion of hydrocarbon comprising:

(a) contacting a metal containing hydrocarbon feed with an active catalyst in a reaction zone under cracking conditions thereby producing cracked product and partially deactivated metal-contaminated catalyst;

(b) separating said cracked product from said partially deactivated metal-contaminated catalyst;

(c) fractionating said cracked products into hydrogen, olefins and other hydrocarbons;

(d) contacting said partially deactivated metal contaminated catalyst with an oxygen-containing gas under regeneration conditions thereby producing a regenerated metal contaminated catalyst;

(e) recycling a portion of said regenerated metal-contaminated catalyst to said reaction zone of step (a);

(f) contacting the remainder of said regenerated metal-contaminated catalyst with a reducing gas under reducing conditions thereby producing a reduced regenerated metal contaminated catalyst;

(g) contacting said reduced regenerated metal-contaminated catalyst with olefin and hydrogen under hydrogenation conditions to produce hydrogenated olefin and partially coked reduced regenerated metal-contaminated catalyst;

(h) separating said hydrogenated olefin from said partially coked reduced regenerated metal-contaminated catalyst;

(i) cycling said hydrogenated olefin to the fractionation system of (c), and (j) recycling said partially coked reduced regenerated metal-contaminated catalyst to the regeneration of (d).

18. A process for the conversion of hydrocarbon according to claim 17 whereiin at least a portion of the olefin and hydrogen contacted under hydrogenation conditions of step (g) is taken from the fractionation of the cracked products of step (c).

* * * * *